United States Patent [19]

Grossmann et al.

[11] Patent Number: 4,638,734

[45] Date of Patent: Jan. 27, 1987

[54] ARRANGEMENT FOR PRINTING MACHINE PLATE CYLINDER ZERO POSITION ADJUSTMENT

[75] Inventors: Stefan Grossmann, Radebeul; Erhard Nitzsche, Dohna, both of German Democratic Rep.

[73] Assignee: EB Kombinat Polygraph "Werner Lamberz" Leipzig, Leipzig, German Democratic Rep.

[21] Appl. No.: 836,235

[22] Filed: Mar. 4, 1986

[30] Foreign Application Priority Data

Mar. 4, 1985 [DD] German Democratic Rep. ... 273756

[51] Int. Cl.[4] ..... B41F 13/14; B41F 33/06

[52] U.S. Cl. ..... 101/248

[58] Field of Search ..... 101/216, 219, 248, 181, 101/152, 153, 136, 141; 340/825.06; 318/65, 572, 600, 601, 603, 626

[56] References Cited

U.S. PATENT DOCUMENTS

| | | | |
|---|---|---|---|
| 3,746,957 | 7/1973 | Forster et al. | 101/248 |
| 4,243,925 | 1/1981 | Gnechtel | 318/603 |
| 4,539,907 | 9/1985 | Johne et al. | 101/248 |
| 4,552,066 | 11/1985 | Giori et al. | 101/152 |

FOREIGN PATENT DOCUMENTS 206648 2/1984 German Democratic Rep. .

*Primary Examiner*—J. Reed Fisher

*Attorney, Agent, or Firm*—Michael J. Striker

[57] ABSTRACT

An arrangement for printing machine plate cylinder adjustment to zero position includes an evaluation circuit which is interposed between a potentiometer which issues an electrical signal representative of the instantaneous position of an adjustment transmission driven by a motor, and motor protection devices for the two senses of rotation of the motor. The evaluation circuit is operative for generating respective control signals for a right-hand end position, for a left-hand end position, for a right-hand switching point, and for a left-hand switching point. A resetting input of a counter incorporated in an incremental displacement measuring system is connected through a NOR-gate having inputs connected to those of the outputs of the evaluation circuit which carry the switching point control signals and through an AND-gate having inputs respectively connected to the NOR-gate output, to an input element for the zero position, and to an output of a pulse generator output which is also incorporated in the incremental displacement measuring system, to the evaluation circuit, while a counting input of the counter is directly connected to the output of the pulse generator.

3 Claims, 4 Drawing Figures

ARRANGEMENT FOR PRINTING MACHINE PLATE CYLINDER ZERO POSITION ADJUSTMENT

BACKGROUND OF THE INVENTION

The present invention relates generally to control arrangements, and more particularly to an arrangement for controlling the adjustment of a plate cylinder of a printing machine to its zero position.

One arrangement for adjusting a zero position of remotely adjustable plate cylinders of printing presses is already known from the German Democratic Republic Pat. No. 206 648, in which the adjustment is accomplished by means of four control cams. However, this known arrangement has the disadvantages of comprising a high number of mechanical elements for the zero position adjustment and the attendant need for time-consuming adjustment, as well as the requirement for zero adjustment after the mechanical elements have suffered a certain degree of wear.

SUMMARY OF THE INVENTION

Accordingly, it is a general object of the present invention to avoid the disadvantages of the prior art.

More particularly, it is an object of the present invention to provide a control arrangement for the adjustment of the zero position of the plate cylinder of a printing press, which does not possess the disadvantages of the known arrangements of this kind.

Still another object of the present invention is so to construct the arrangement of the type here under consideration as to reduce the number of mechanical elements needed for the zero adjustment to a minimum.

It is yet another object of the present invention to develop an arrangement of the above type in which the amount of the adjustment expenditure is minimized.

A concomitant object of the present invention is so to design the arrangement of the above type as to be relatively simple in construction, inexpensive to manufacture, easy to use, and reliable in operation nevertheless.

In pursuance of these objects and others which will become apparent hereafter, one feature of the present invention resides in an arrangement for controlling the operation of a motor, which has a mechanical output connected by a transmission to a plate cylinder of a printing machine and electrical inputs connected to respective protection devices for the two senses of rotation of the motor, during the adjustment of the plate cylinder to a zero position, comprising potentiometer means for detecting and issuing an electrical signal representative of the instantaneous position of the transmission; an evaluation circuit having an input connected to the potentiometer means and four outputs and operative for generating and presenting at the respective ones of the outputs respective control signals for a right-hand end position, for a left-hand end position, for a right-hand switching point, and for a left-hand switching point; an input element for the zero position; a plurality of AND-gates interposed between the evaluation circuit outputs and the protection devices and connected to the input element; an incremental displacement measuring system including a pulse generator having an output and a counter having a counting input connected to the pulse generator output and a resetting input; a NOR-gate having inputs connected to the evaluation circuit outputs and an output; and another AND- gate having inputs respectively connected with the NOR-gate output, to the input element, and to the pulse generator output, and an output connected to the resetting input of the counter.

It is particularly advantageous when the incremental displacement measuring system further includes an indication and control element connected with the counter for a two-way exchange of information and having a first data port connected to the input element for the zero position, and second and third data ports respectively connected to the inputs of the protection devices.

According to another advantageous concept of the present invention, the evaluation circuit includes a first resistor combination including a zero point fine correction resistor connected with negative and positive operating voltage terminals and having a tap, a first fixed resistor connected to the tap, and a feedback resistor connected to the first resistor; a voltage follower amplifier connected at its input side to the potentiometer and to the first resistor combination; four comparators each having a first input connected with the voltage amplifier output and a second input and respectively operative for generating the control signals for the right-hand end position, for the left-hand end position, for the right-hand switching point, and for the left-hand switching point; a second resistor combination including a series connection of a second fixed resistor, a variable resistor and a third fixed resistor; means for connecting respective points situated between the second and third resistors and the variable resistor with the second inputs of the comparators for the right-hand and the left-hand end position; a third resistor combination including a series connection of a fourth fixed resistor, an adjustable resistor and a fifth fixed resistor; and means for connecting respective points situated between the fourth and fifth resistors and the adjustable resistor with the second inputs of the comparators for the right-hand and the left-hand switching point.

The novel features which are considered as characteristic of the invention as set forth in particular in the appended claims. The improved control arrangement for printing machine plate cylinder zero position adjustment itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
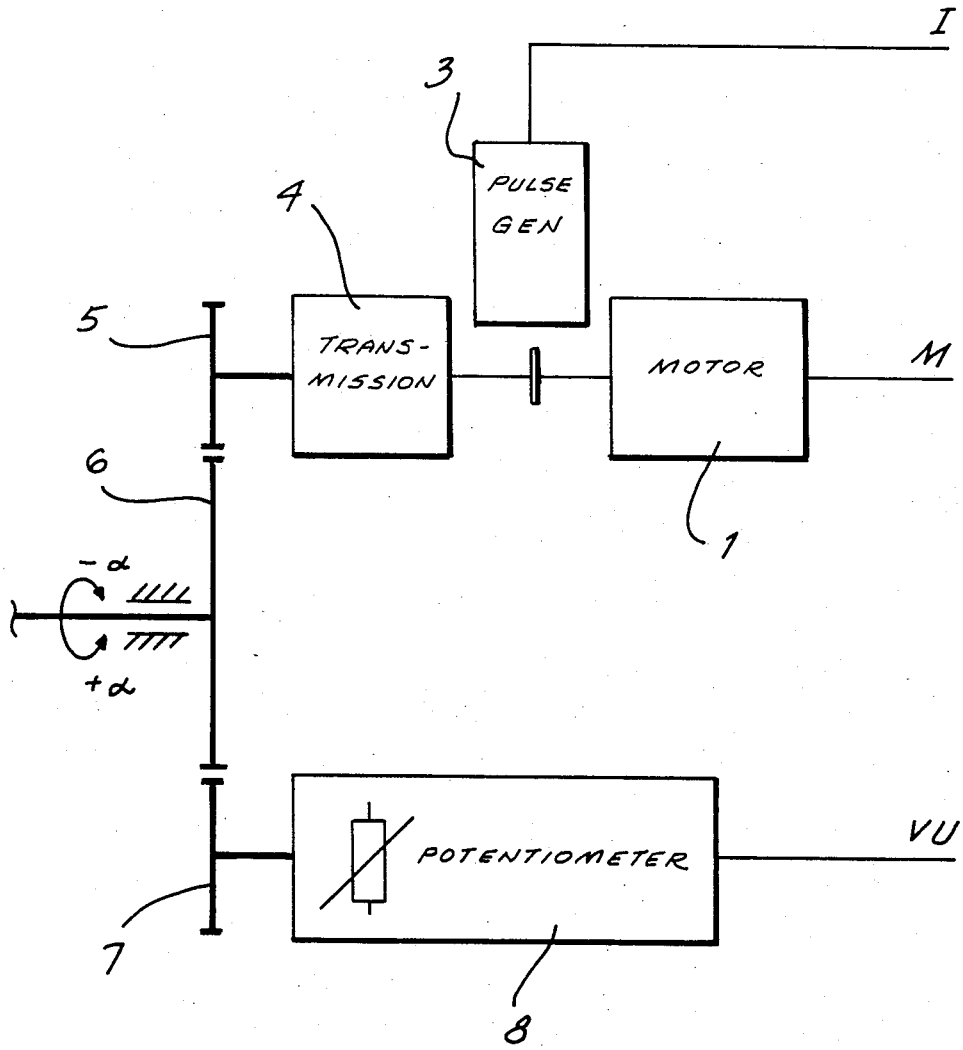
FIG. 1 is a diagrammatic top plan view of an adjustment drive constructed in accordance with the present invention.

Referring now to the drawing in detail, and first to FIG. 1 thereof, it may be seen that it diagrammatically depicts an adjustment transmission for a remote adjustment of a plate cylinder. Two such adjustment transmissions are provided for each plate cylinder, one for the radial, and the other for the axial, adjustment thereof. The mode of operation of both adjustment transmissions, however, is the same, so that the present invention will be explained below in conjunction with only one such adjustment transmission and an associated control arrangement.

A motor 1, which is advantageously constructed as a braked motor, is provided at the driving end of the remote adjustment unit. A control cam 2 is mounted for joint rotation on the output shaft of the motor 1, and a pulse generator 3 is associated with this control cam 2. An inductive proximity initiator can be used as the pulse generator 3. The output shaft of the motor 1 is further connected with a highly reducing hypocyclic transmission 4. An output gear 5 is mounted for joint rotation on the output shaft of the transmission 4. The output gear 5 meshes with another gear 6 which causes a direct displacement of the plate cylinder, for instance in the axial displacement drive via a non-illustrated worm gear transmission. The other gear 6 further meshes with an auxiliary gear 7 which is mounted for rotation on an auxiliary shaft. A potentiometer 8, which is advantageously constructed as a multi-turn potentiometer, is arranged on the auxiliary shaft of the auxiliary gear 7.

Figure 2:
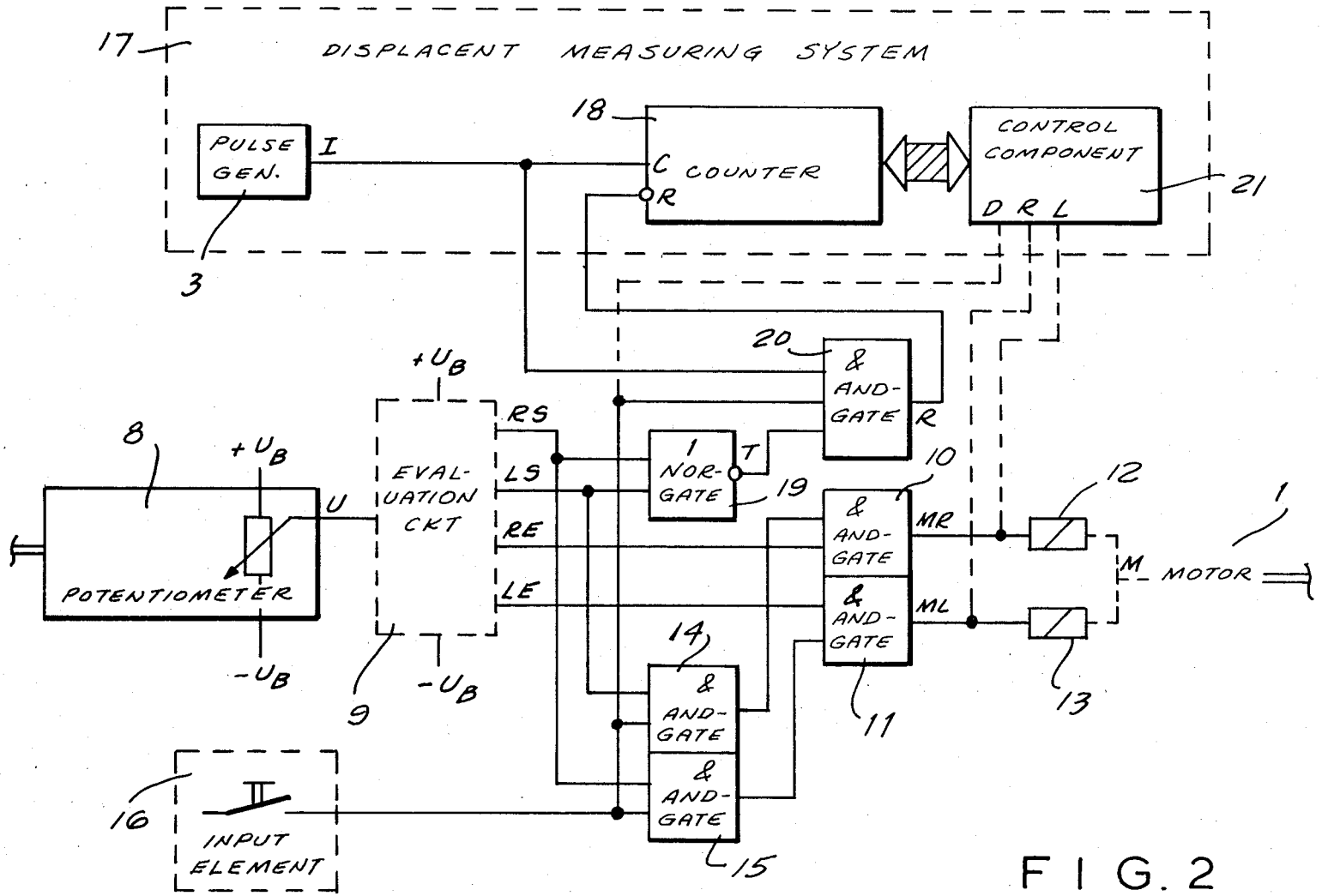
FIG. 2 is a circuit diagram of an electronic control arrangement of the present invention for use with the adjustment drive of FIG. 1.

As illustrated in FIG. 2 of the drawing, an electric output of the potentiometer 8 is connected with an input of an evaluation circuit 9 which is operative for generating and presenting at respective outputs thereof respective control signals RE for the right-hand end position, LE for the left-hand end position, RS for a right-hand switching point, and LS for a left-hand switching point. Electric inputs of the motor 1 are connected to those outputs of the evaluation circuit 9 which carry the control signal RE for the right-hand end position and the control signal LE for the left-hand end position via respective connecting AND-gates 10 and 11 and respective motor protection devices 12 and 13 for the two senses of rotation of the motor 1. Another input of each of the connecting AND-gates 10 and 11 is connected via a respective switching point AND-gate 14 and 15 to those outputs of the evaluation circuit 9 which carry the control signal RS for the right-hand switching point and the control signal LS for the left-hand switching point, respectively. Another input of each of the switching point AND-gates 14 and 15 is connected to an output of an input element 16 for the zero position.

The pulse generator 3 forms a part of an incremental displacement measuring system 17 which further includes a counter 18 which is connected to the output of the pulse generator 3. A resetting input R of the counter 18 is connected, via a NOR-gate 19 and an AND-gate 20 with those of the outputs of the evaluation circuit 9 which carry the control signals RS and LS for the right-hand and left-hand switching points. Another input of the AND-gate 20 is connected with the output of the input element 16 for the zero position and a further input of the AND-gate 20 is connected with the output of the pulse generator 3.

In accordance with a further development and enhancement of the basic concept of the present invention, the incremental displacement measuring system 17 is further equipped with an indication and control component 21 which is connected with the counter 18 for a two-way exchange of information. The indication and control component 21 has data ports D, R and L of which the data port D is connected to the connection between the input element 11 for the zero position, and the data ports R and L are connected to the respective connections between the AND-gates 10 and 11 and the motor protection devices 12 and 13.

Figure 3:
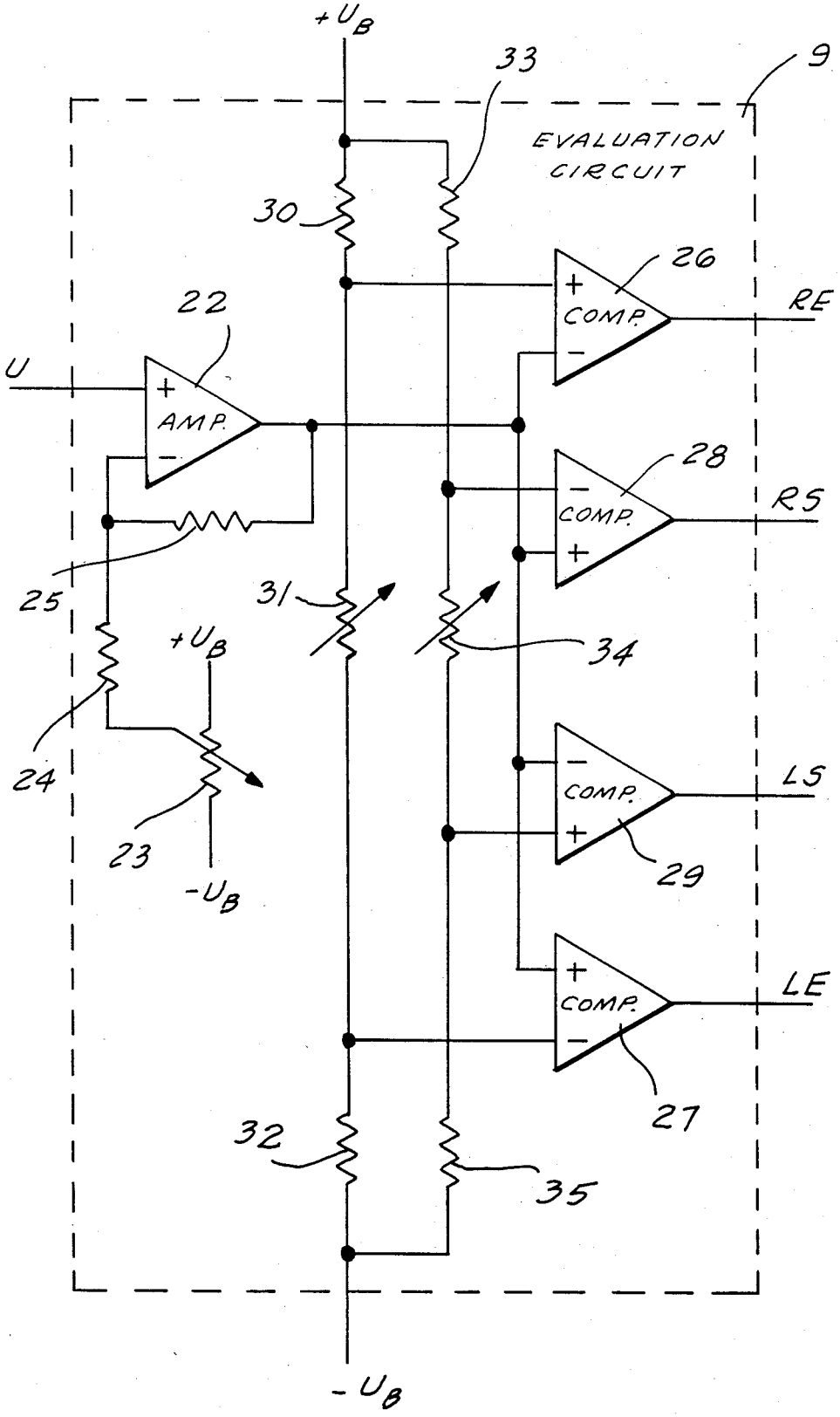
FIG. 3 is a detailed diagrammatic view of an evaluation circuit incorporated in the control arrangement of FIG. 2.

As shown in more detail in FIG. 3 of the drawing, the evaluation circuit 9 includes a voltage follower amplifier 22 that has one input connected with the output of the potentiometer 8 and another input which is connected with a first combination of resistors 23, 24 and 25. The resistor combination 23, 24 and 25 includes a zero point fine correction resistor 23 which is connected to the positive and negative operating voltage terminals $+U_B$ and $-U_B$ and includes a tap which is connected to the input of the resistor 24 which has a fixed resistance value, while the output of the fixed resistor 24 is connected to the other input of the voltage follower amplifier 22, as well as a feedback resistor 25. The evaluation circuit 9 further includes respective comparators 26 for the right-hand end position, 27 for the left-hand end position, 28 for the right-hand switching point, and 29 for the left-hand switching point, the comparators 26, 27, 28 and 28 having respective first inputs which are connected with the output of the voltage follower amplifier 22.

The evaluation circuit 9 also includes a second combination of resistors 30, 31 and 32 and a third combination of resistors 33, 34 and 35. The second resistor combination 30, 31 and 32 includes a second fixed resistor 30, a variable resistor 31 and a third fixed resistor 32. A voltage tap situated between the second fixed resistor 30 and the variable resistor 31 is connected with a second input of the comparator 26 for the right-hand end position, while another voltage tap situated between the third fixed resistor 32 and the variable resistor 31 is connected with a second input of the comparator 27 for the left-hand end position. The third resistor combination 33, 34 and 35 includes a fourth fixed resistor 33, an adjustable resistor 34 and a fifth fixed resistor 35. A voltage tap situated between the fourth fixed resistor 33 and the adjustable resistor 34 is connected with a second input of the comparator 28 for the right-hand switching point, while another voltage tap situated between the fifth fixed resistor 35 and the adjustable resistor 34 is connected with a second input of the comparator 29 for the left-hand switching point.

Having so described the construction of the arrangement depicted in FIGS. 1 to 3 of the drawing, the operation of this arrangement will now be explained still with reference to FIGS. 1 to 3 taken in conjunction with FIG. 4 of the drawing. Corresponding reference characters have been used in the various Figures of the drawing to identify corresponding signal values and characteristic lines.

The potentiometer 8 furnishes a voltage U which is proportional to the angular position or displacement of the gear 7 and thus to the displacement of the plate cylinder of the printing machine to the evaluation circuit 9. It is possible to perform a fine zero point equalization at the voltage follower amplifier 22 by means of the first resistor combination 23, 24 and 25. The illustrated arrangement for the zero point equalization, which includes the resistors 23, 24 and 25, is utilized several times in order to compensate for the input offset voltage of the voltage follower amplifier 22 which is constructed as an operational amplifier, so that a voltage of 0 V is indeed encountered at the output of the amplifier 22 when the voltage U supplied to the input of the amplifier 22 amounts to 0 V. When the zero point adjustment range is made sufficiently large by appropriately selecting the resistivities of the resistors 23, 24 and 25, it is possible to equalize input voltages U which deviate by upto several tens of millivolts from 0 V to 0 V at the output. This voltage compensation or equalization is particularly advantageous when the measuring potentiometer 8 is of such a construction that it cannot be exactly adjusted. The asymmetry of the voltage U, which is caused by the inexact adjustment of the potentiometer 8, with respect to switching points a and d which are shown in FIG. 4 and which are realized by the comparators 26 and 27 for the right-hand and left-hand end positions illustrated in FIG. 3, is removed in this manner and a simple switching point setting is rendered possible.

The comparators 26 and 27 provide the logic control signals RE for the right-hand end position and LE for the left-hand end position. These signals RE and LE are then used for the setting range limitation of the switching points a and d. The switching points of the comparators 28 and 29 are so selected that a logic signal RS or LS is switched on at the output of the respective comparator 28 or 29 only when operating in a predetermined setting range. Switching points b and c which are shown in FIG. 4 and which are formed by the signals LS and RS, are to be selected in such a manner that the motor stoppage from the left-hand setting range, as well as from the right-hand setting range, occurs exactly at the zero point. The setting of the switching points b and c is advantageously accomplished by means of the adjustable resistor 34 which is included in the evaluation circuit 9. The end position limitation is also performed in a zero point symmetrical fashion. The setting of the end position switching points a and d is accomplished by means of the variable resistor 31. When the same resistance values are chosen for the resistors 30 and 32, then the reference voltages for the comparators 26 and 27 are changed zero point symmetrically during the adjustment of the variable resistor 31, based on the resulting voltage division. The same is analogously true about the third resistor arrangement 33, 34 and 35. The zero point is the ground of the operating voltage supply of $+U_B$ and $-U_B$.

The adjustment movement for the approach of the zero position is triggered by means of the input element 16 for the zero position. The control signals RS and LS are so coupled in a known manner by means of the AND-gates 10, 11, 14, 15 and 19 that the motor protection device 12 is switched in the right-hand adjustment range of the motor protection device 12.

It is already known that it is possible to balance an analog system quite accurately relative to a zero point. However, what is disadvantageous in this context is the limited accuracy of a linear displacement measurement, so that the incremental measuring system 17 is used for this purpose. The adjustment operations for the remote adjustments of the plate cylinder are performed after a measurement of the actual position of the print edges or register marks after the accomplished zero adjustment of the plate cylinders. An exact displacement measurement for these adjustment operations can be achieved with the incremental displacement measuring system 17.

Figure 4:
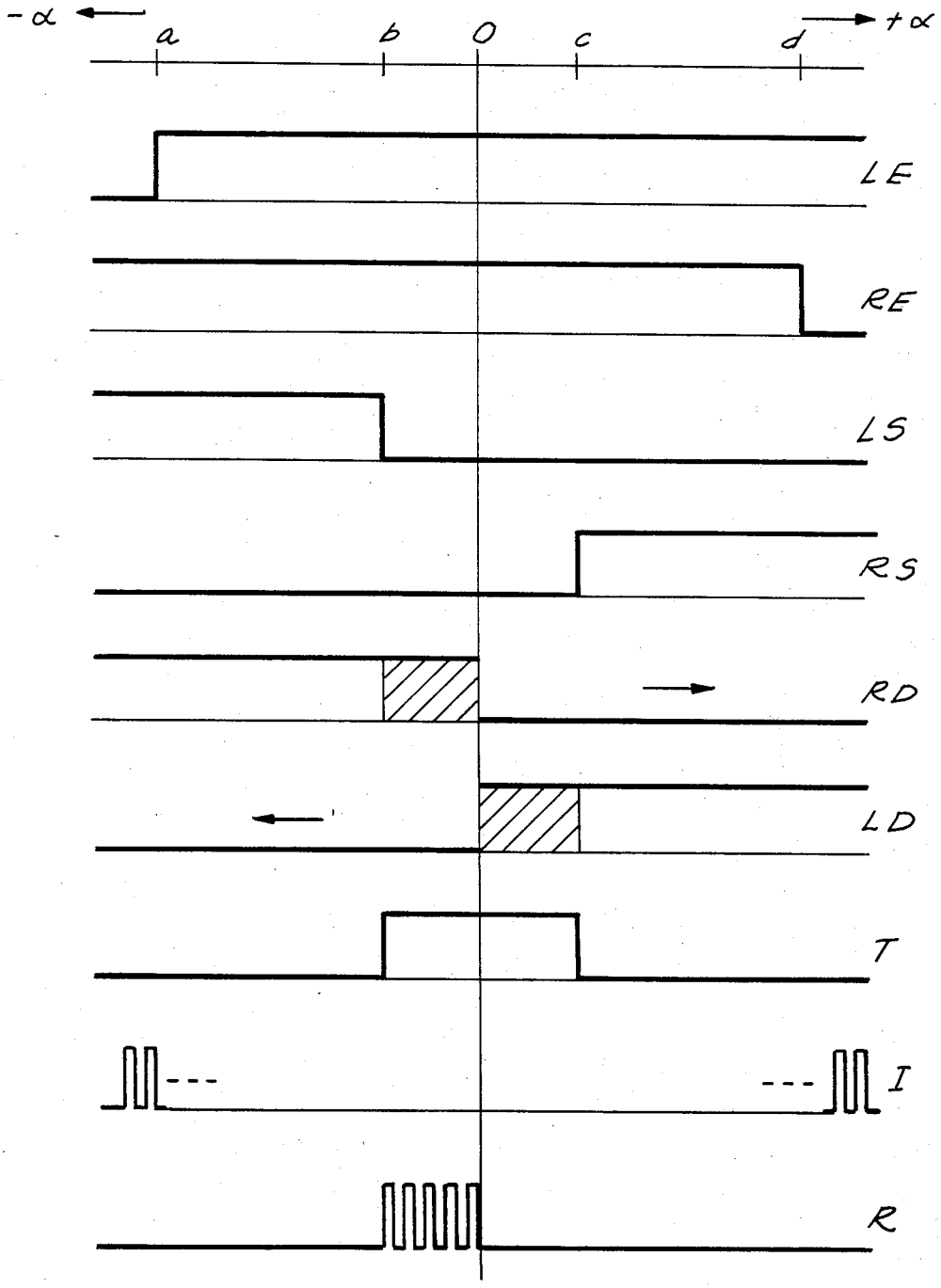
FIG. 4 is a timing diagram of the various signals encountered during the operation of the control arrangement of FIG. 2.

The functions or behaviors of the various components depicted in FIGS. 2 and 3 of the drawing are illustrated in FIG. 4 on the basis of the signals issued by such components. The turning of the gear 6 is characterized by an angle. The switching points a and d constitute the end position switching-off pulses for the delimitation of the adjustment range. The control signals LE and SE associated therewith are presented at the outputs of outputs of the comparators 26 and 27. The signal LE, for instance, limits the extent of the leftward displacement of the motor 1 to the switching point 1.

The significance of the signals LS and LD it that they indicate after the issuance of a command for the zero position whether the adjustment unit is situated in the left-hand or in the right-hand adjustment range. When the adjustment drive is in the left-hand adjustment range, then a rightward rotation is triggered. The actual movement is represented by signals RD for the rightward rotation or LD for the leftward rotation.

A signal T is produced from the signals LS and RS by the NOR-gate 19. The output of the pulse generator 3 furnishes a continuous succession of pulses which are identified by the reference character I. Thus, the signal R which appears at the output of the AND-gate 20 constitutes a combination of the signal T with the signal I. When the output signals RS and LS of the evaluation circuit 9 are combined by the NOR-gate 19, it is possible to furnish to the resetting input of the counter 18 while operating in the range between the switching points b and c those of the pulses I associated with the operation of the motor 1 which have been generated by the pulse generator 3 after the switching-off of the motor 1 due to overshoot. As a result of this, the counter 18 is reset, when the switching points b and c are exactly balanced, to the value of zero for so long until the motor 1 has actually reached the desired zero point position. Thus, the pulses appearing at a counting input C of the counter 18 are rendered ineffective. As a consequence of this, even the displacement measuring system 17 is set to zero after the completion of the zero-position approach operation.

The information concerning the sense of rotation of the motor 1 can be obtained from signals MR or ML which appear at the outputs of the respective connecting AND-gates 10 and 11, and can be supplied to the indication and control component 21. It is further advantageous when the indication of the incremental displacement measuring system 17 is dark-sensed during the performance of the zero point adjustment operation via the port D. The signals MR or ML can be supplied to the indication and control component 21 for the indication of the sense of rotation.

It will be understood that each of the elements described above, or two or more together, may also find a useful application in other types of arrangements differing from the type described above.

While the invention has been illustrated and described as embodied in an arrangement for controlling the adjustment of a printing cylinder to its zero position, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. An arrangement for controlling the operation of a motor, which has a mechanical output connected by a transmission to a plate cylinder of a printing machine and electrical inputs connected to respective protection devices for the two senses of rotation of the motor, during the adjustment of the plate cylinder to a zero position, comprising potentiometer means for detecting and issuing an electrical signal representative of the instantaneous position of the transmission; an evaluation circuit having an input connected to said potentiometer means and four outputs and operative for generating and presenting at the respective ones of said outputs respective control signals for a right-hand end position, for a left-hand end position, for a right-hand switching point, and for a left-hand switching point; an input element for the zero position; a plurality of AND-gates interposed between said evaluation circuit outputs and the protection devices and connected to said input element; an incremental displacement measuring system including a pulse generator having an output and a counter having a counting input connected to said pulse generator output and a resetting input; a NOR-gate having inputs connected to those of said outputs of said evaluation circuit which carry said switching point control signals, and an output; and another AND-gate having inputs respectively connected to said NOR-gate output, to said input element, and to said pulse generator output, and an output connected to said resetting input of said counter.

2. The arrangement as defined in claim 1, wherein said incremental displacement measuring system further includes an indication and control element connected with said counter for a two-way exchange of information and having a first data port connected to said input element for the zero position, and second and third data ports respectively connected to the input of said protection devices.

3. The arrangement as defined in claim 1, wherein said evaluation circuit includes a first resistor combination including a zero point fine correction resistor connected with negative and positive operating voltage terminals and having a tap, a first fixed resistor connected to said tap, and a feedback resistor connected to said first resistor; a voltage follower amplifier connected at its input side to said potentiometer and to said first resistor combination; four comparators each having a first input connected with the voltage amplifier output and a second input and respectively operative for generating said control signals for said right-hand end position, for said left-hand end position, for said right-hand switching point, and for said left-hand switching point; a second resistor combination including a series connection of a second fixed resistor, a variable resistor and a third fixed resistor; means for connecting respective points situated between said second and third resistors and said variable resistor with said second inputs of said comparators for said right-hand and said left-hand end position; a third resistor combination including a series connection of a fourth fixed resistor, an adjustable resistor and a fifth fixed resistor; and means for connecting respective points situated between said fourth and fifth resistors and said adjustable resistor with said second inputs of said comparators for said right-hand and said left-hand switching point.

* * * * *